US006938927B1

(12) United States Patent
Martin et al.

(10) Patent No.: US 6,938,927 B1
(45) Date of Patent: Sep. 6, 2005

(54) TELESCOPING HAND HELD POLE

(76) Inventors: Michael J. Martin, 11612 Sasanque La., Dallas, TX (US) 75218; Leonard L. Hofheins, 930 Detroit Ave., Suite E, Concord, CA (US) 94518

( * ) Notice: Subject to any disclaimer, the term of this patent is extended or adjusted under 35 U.S.C. 154(b) by 49 days.

(21) Appl. No.: 10/611,138

(22) Filed: Jul. 1, 2003

(51) Int. Cl.[7] ..... A45B 5/00; A63C 11/22

(52) U.S. Cl. ..... 280/819; 280/821; 280/823; 135/69

(58) Field of Search ..... 135/65, 69, 75, 135/911; 280/819, 822, 823

(56) References Cited

U.S. PATENT DOCUMENTS

| | | | | | |
|---|---|---|---|---|---|
| 401,061 | A * | 4/1889 | Pilon et al. | 135/75 |
| 2,818,290 | A * | 12/1957 | Harocopo | 403/108 |
| 3,712,652 | A * | 1/1973 | Uilkema | 403/108 |
| 3,987,807 | A * | 10/1976 | Varnell | 135/66 |
| 4,424,987 | A * | 1/1984 | Ryder | 280/823 |
| 4,596,405 | A * | 6/1986 | Jones | 280/823 |
| 4,616,668 | A * | 10/1986 | Battiston | 135/75 |
| 5,387,048 | A * | 2/1995 | Kuo | 403/109.3 |
| 5,441,307 | A * | 8/1995 | Quintana et al. | 280/823 |
| 5,478,117 | A * | 12/1995 | Quintana et al. | 280/823 |
| 5,593,239 | A * | 1/1997 | Sallee | 403/109.3 |
| 5,778,914 | A * | 7/1998 | Trani | 135/66 |
| 5,941,435 | A * | 8/1999 | Munro, III | 224/267 |
| 6,003,915 | A * | 12/1999 | Bierman | 294/51 |
| 6,217,072 | B1 * | 4/2001 | Gregg | 280/823 |
| 6,217,073 | B1 * | 4/2001 | Hoffman | 280/823 |
| 6,341,614 | B1 * | 1/2002 | Tucker et al. | 135/75 |
| 6,354,629 | B1 * | 3/2002 | McNeal et al. | 280/823 |
| 6,749,227 | B2 * | 6/2004 | Margid | 280/823 |
| 6,782,903 | B1 * | 8/2004 | Jarman et al. | 135/75 |

* cited by examiner

*Primary Examiner*—Chris Ellis
*Assistant Examiner*—Kelly E Campbell
(74) *Attorney, Agent, or Firm*—Thomas R. Lampe

(57) ABSTRACT

A telescoping, hand held pole includes telescoping pole segments releasably locked together by lock members. A lock release mechanism employed in the pole includes a manually engageable member which, when pushed, initiates unlocking of all of the lock members, allowing telescoping of all of the telescoping pole segments.

7 Claims, 2 Drawing Sheets

TELESCOPING HAND HELD POLE

TECHNICAL FIELD

This invention relates to a telescoping or collapsible hand held pole. The invention has particular application to use as a ski pole, however it may also be employed effectively as a walking stick.

BACKGROUND OF THE INVENTION

Conventional ski poles and poles employed as walking sticks do not telescope, that is, they have a fixed predetermined length. They are cumbersome and awkward to carry under certain circumstances. Although collapsible poles have been devised, such prior art devices are characterized by their relative complexity, expense and lack of ease of use.

DISCLOSURE OF INVENTION

The present invention relates to a telescoping pole which provides a number of advantages over non-collapsible poles such as ski poles. A skier who skis hands free can stow or secure the telescoped pole out of the way and readily extend it to full size when desired, for example to navigate at the bottom of the slope back to the lift or lodge. The collapsible pole provides a comfort zone to the user of having something in his or her hand while skiing and can act as a brake during a fall to slow a skier's slide. The collapsible pole can be made compact when riding a ski lift or roaming around with hands occupied, for example when carrying skis and holding a child's hand. The pole when in collapsed condition can be used when engaging in certain activities such as trick skiing or snow boarding.

The telescoping, hand held pole of the present invention incorporates a plurality of telescoping pole segments including a handle pole segment, a ground contacting pole segment and at least one intermediate pole segment located between the handle pole segment and the ground contacting pole segment.

The pole also incorporates a plurality of lock members including a lock member for locking the handle pole segment and an intermediate pole segment engaging the handle pole segment against telescopic movement and a lock member for locking the ground contacting pole segment and an intermediate pole segment engaging the ground contacting pole segment against telescopic movement.

The pole additionally comprises a lock release mechanism including a manually engageable member located on one of the telescoping pole segments for initiating unlocking of all the lock members allowing telescoping of all the telescoping pole segments responsive to opposed end-wise forces being applied to the pole.

Other features, advantages and objects of the present invention will become apparent with reference to the following description and accompanying drawings.

BEST MODE FOR CARRYING OUT THE INVENTION

Figure 1:
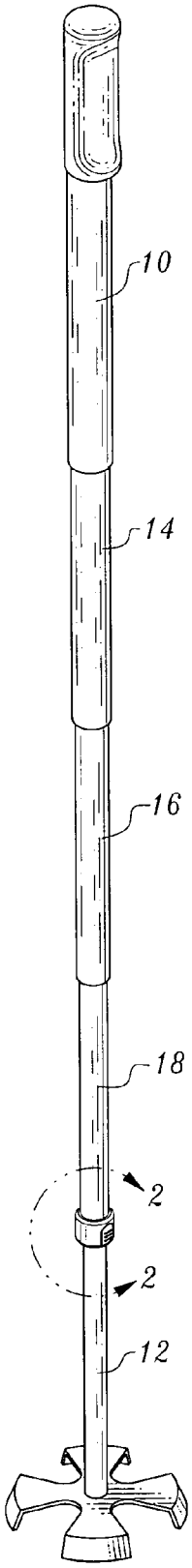
FIG. 1 is a perspective view of a non-telescoped ski pole constructed in accordance with the teachings of the present invention.
Figure 2:
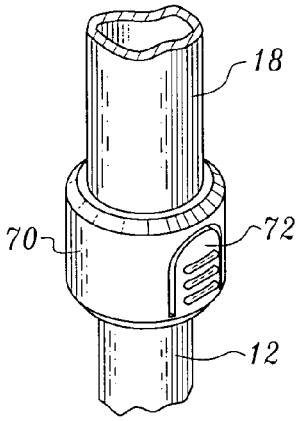
FIG. 2 is an enlarged view of that portion of the pole delineated by double headed arrow 2—2 in FIG. 1.

Referring now to the drawings, a telescoping, hand held ski pole constructed in accordance with the teachings of the present invention includes a handle pole segment 10, a ground contacting pole segment 12 and intermediate pole segments 14, 16, 18 located between the handle pole segment 10 and the ground contacting pole segment 12.

The pole incorporates a number of lock members including a lock member 30 for locking the handle pole segment 10 and intermediate pole segment 14 engaging the handle pole segment against telescopic movement. A lock member 32 locks the ground contacting pole segment 12 and intermediate pole segment 18 engaging the ground contacting pole segment against telescopic movement. Lock member 34 is employed to lock intermediate pole segments 16, 18 against movement and lock member 36 is employed to lock intermediate pole segments 14, 16 against movement.

The lock members 30, 34 and 36 comprise release arms 40, 42, 44, respectively, pivotally connected to ends of pole segments 10, 18 and 16, respectively, and disposed in the interiors thereof. The sizes of the release arms gradually become smaller in the direction of the ground contacting end of the pole, otherwise the configurations and operations of the release arms 40, 42, 44 are essentially the same. Each release arm has a detent 50 at one end thereof. Release arms 40, 42, 44 are respectively pivotally mounted on supports 52, 54, 56 attached to and located at the upper ends of pole segments 14, 18, 16, respectively.

The lock member employed to releasably lock ground contacting pole segment 12 to intermediate pole segment 18 comprises a detent 50 attached directly to a leaf spring 58 depending downwardly from support 59 attached to the top of pole segment 12. The spring 58 continuously biases the detent 50 attached thereto in an outward direction.

Each release arm 40, 42, 44 is pivotally movable between a first position wherein the detent 50 thereof is positionable in a hole 62 formed in an adjoining pole segment and a second position wherein the detent is removed from the hole. The detents pass through openings formed in their respective pole segments which register with the detents. A keyway (not shown) or other suitable arrangement may be used to keep the pole segments from relatively rotating. A biasing element in the form of leaf spring 60 is cooperable with each release arm to continually bias the release arm toward the first position. When the pole is fully extended, the detents 50 align with the holes 62 to maintain the pole in such extended position. The biasing element associated with each release arm maintains the detent in its associated hole.

Lock release mechanism is incorporated in the pole enabling a user to initiate unlocking of all of the lock members, allowing telescoping of all of the telescoping pole segments responsive to opposed end-wise compressive forces being applied to the pole. The lock release mechanism includes a manually engageable member 70 connected to and disposed outwardly of intermediate pole segment 18. Manually engageable member 70 includes a segment 72 which can readily be deflected inwardly when a user's finger applies pressure thereto. Attached to segment 72 is a protrusion 74 which is aligned with detent 50 depending from leaf spring 58. The protrusion is utilized to dislodge the detent from the hole in pole segment 18, allowing the ground contacting pole segment to be telescoped therein.

Figure 3:
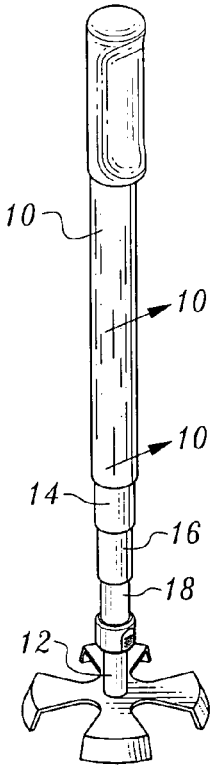
FIG. 3 is a perspective view of the ski pole in telescoped condition.
Figure 4:
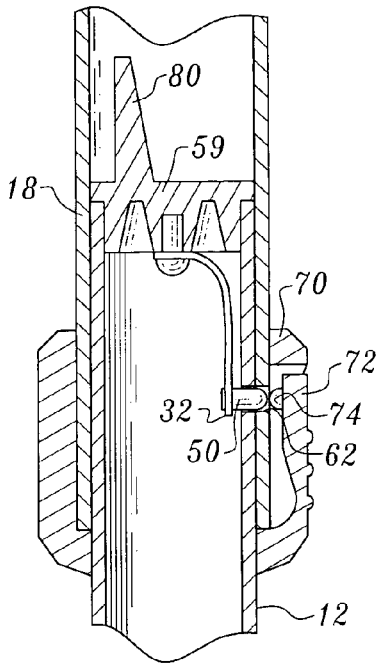
FIG. 4 is an enlarged, cross-sectional view of portions of ground contacting and intermediate pole segments locked against movement by a lock member.
Figure 5:
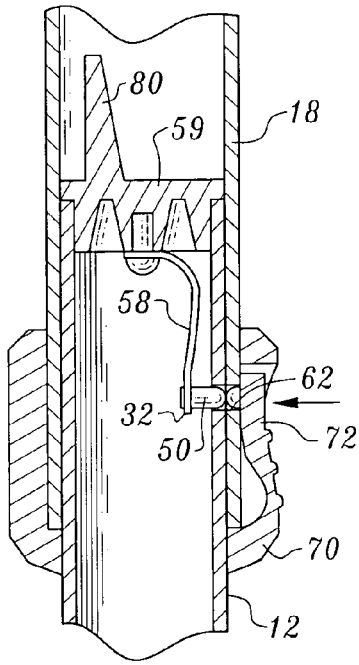
FIG. 5 is a view similar to FIG. 4, but showing a manually engageable member moving the lock member to unlocking position.
Figure 6:
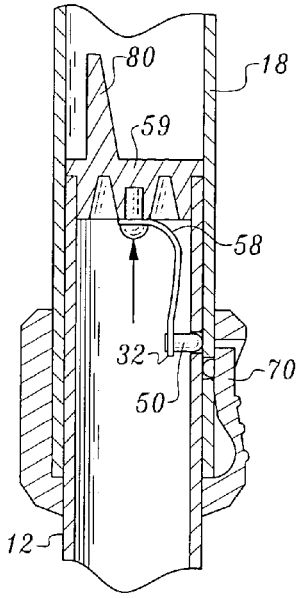
FIG. 6 is a view similar to FIGS. 4 and 5, but showing telescoping movement between the pole segments after the lock member has been moved to unlocked position.
Figure 7:
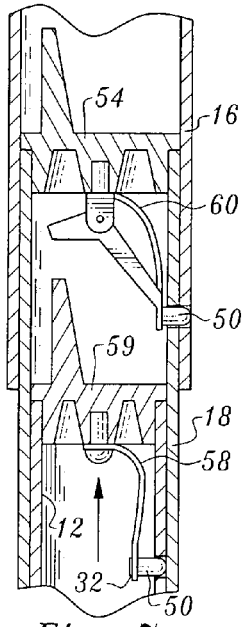
FIG. 7 shows the upper end of the ground contracting pole segment approaching a lock member at the upper end of the intermediate pole segment.
Figure 10:
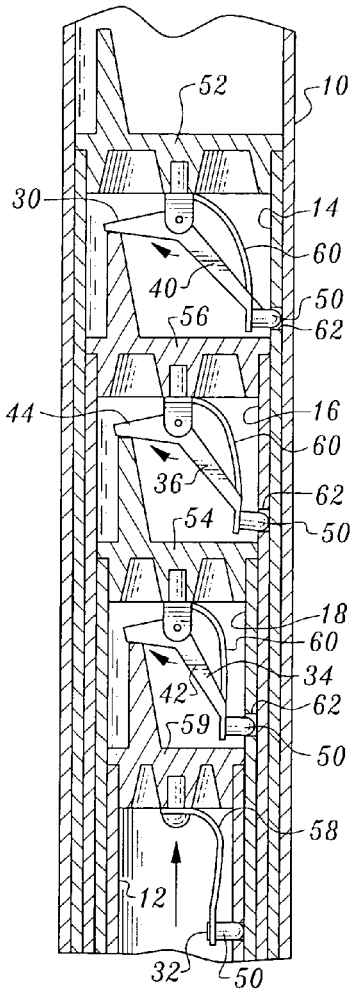
FIG. 10 is an elongated, cross-sectional view showing portions of all pole segments in telescoped condition.
Figure 8:
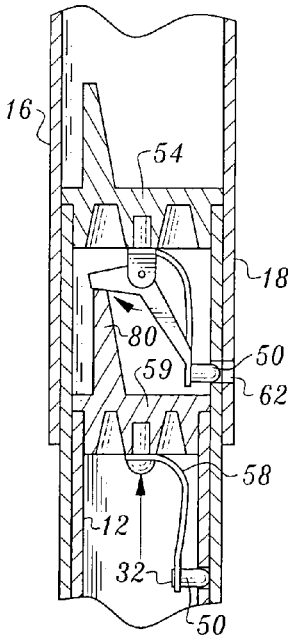
FIG. 8 shows an abutment member on the ground contacting segment engaging the lock member at the upper end of the intermediate pole segment or unlock the lock member.
Figure 9:
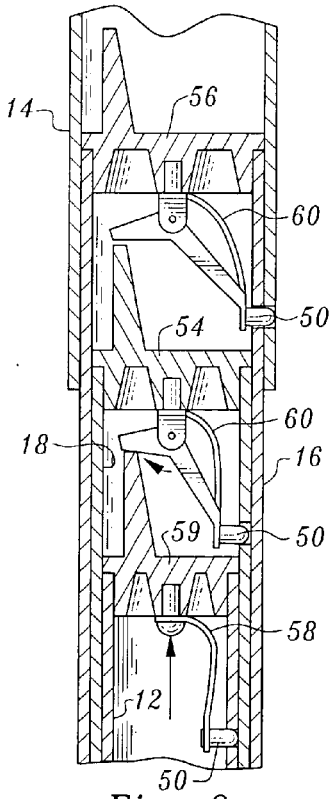
FIG. 9 is an enlarged, cross-sectional view showing the intermediate pole segment engaged by the ground engaging pole segment approaching the lock member of a second intermediate pole segment.

Projecting upwardly from the support 59 attached to the upper end of the ground contacting pole segment is a protrusion 80. When protrusion or abutment member 80 contacts release arm 42, it will pivot that release arm against the bias exerted by the associated release spring and cause the detent of release arm 42 to withdraw from the hole 62 formed in adjoining intermediate pole segment 18. Intermediate pole segment 18 will in turn telescope into adjoining intermediate pole segment 16 and engage release arm 44 to rotate it and withdraw its detent from the hole 62 of the next pole segment. This action continues until the pole is completely telescoped or collapsed as shown in FIGS. 3 and 10. The pole may readily be returned to its elongated condition by exerting opposed pulling forces on the handle pole segment and the ground contacting pole segment, the lock members automatically operating to again releasably lock together the pole segments in extended condition.

The invention claimed is:

1. A telescoping, hand held pole for use as a ski pole or walking stick comprising, in combination:

a plurality of telescoping pole segments including a handle pole segment, a ground contacting pole segment and at least one intermediate pole segment located between said handle pole segment and said ground contacting pole segment;

a plurality of lock members including a lock member for locking said handle pole segment and an intermediate pole segment engaging said handle pole segment against telescopic movement and a lock member for locking said ground contacting pole segment and an intermediate pole segment engaging said ground contacting pole segment against telescopic movement;

lock release mechanism including a manually engageable member located on one of said telescoping pole segments for initiating unlocking of all of said lock members allowing telescoping of all of said telescoping pole segments responsive to opposed end-wise forces being applied to said pole, at least some of said lock members comprising release arms, each release arm being pivotally connected to a pole segment and having a detent, each of said release arms being pivotally movable between a first position wherein the detent thereof is positionable in a hole formed in an adjoining pole segment and a second position wherein said detent is removed from said hole; and a biasing element cooperable with each of said release arms to continually bias the release arms toward the first position thereof.

2. The pole according to claim 1 wherein a plurality of interconnecting intermediate pole segments are located between said handle pole segment and said ground contacting pole segment, a lock member operatively associated with each intermediate pole segment locking each intermediate pole segment against movement relative to an adjoining intermediate pole segment.

3. The pole according to claim 1 wherein at least one of said pole segments has an abutment member projecting therefrom engageable with the release arm associated with an adjoining pole segment during telescoping of said pole to move the release arm associated with the adjoining pole segment against the bias exerted by its associated biasing element to the second position thereof and remove the detent thereof from the hole formed in a third pole segment.

4. The pole according to claim 3 wherein each of the release arms is pivotally mounted on a support fixedly connected to a pole segment and located in the interior of the pole segment, said abutment member projecting from said support in a direction away from the release arm pivotally mounted on said support.

5. The pole according to claim 1 wherein said manually engageable member is located on said ground contacting pole segment.

6. The pole of claim 1 comprising a ski pole.

7. A telescoping, hand held pole for use as a ski pole or walking stick comprising, in combination:

a plurality of telescoping pole segments including a handle pole segment, a ground contacting pole segment and at least one intermediate pole segment located between said handle pole segment and said ground contacting pole segment;

a plurality of lock members including a lock member for locking said handle pole segment and an intermediate pole segment engaging said handle pole segment against telescopic movement and a lock member for locking said ground contacting pole segment and an intermediate pole segment engaging said ground contacting pole segment against telescopic movement; and lock release mechanism including a manually engageable member located on one of said telescoping pole segments for initiating unlocking of all of said lock members allowing telescoping of all of said telescoping pole segments responsive to opposed end-wise forces being applied to said pole, at least some of said lock members comprising release arms, each release arm being pivotally connected to a pole segment and having a detent, each of said release arms being pivotally movable between a first position wherein the detent thereof is positionable in a hole formed in an adjoining pole segment and a second position wherein said detent is removed from said hole, said manually engageable member being connected to and disposed outwardly of one of said telescoping pole segments and selectively engageable with a detent projecting through a hole formed therein to move said detent inwardly away from said hole.

* * * * *